US008596905B2

(12) United States Patent
Stephens

(10) Patent No.: US 8,596,905 B2
(45) Date of Patent: Dec. 3, 2013

(54) APPARATUS AND METHOD FOR APPLYING ADDITIVES TO A CONCRETE MIX

(76) Inventor: John Scott Stephens, Lubbock, TX (US)

( * ) Notice: Subject to any disclaimer, the term of this patent is extended or adjusted under 35 U.S.C. 154(b) by 88 days.

(21) Appl. No.: 12/794,848

(22) Filed: Jun. 7, 2010

(65) Prior Publication Data

US 2011/0299924 A1 Dec. 8, 2011

(51) Int. Cl.
*E01C 19/22* (2006.01)
*E01C 19/38* (2006.01)

(52) U.S. Cl.
USPC ..... 404/118; 404/102

(58) Field of Classification Search
USPC ..... 404/75, 114, 118, 120, 124, 133.05, 404/133.1, 133.2, 101, 103, 117, 119, 122, 404/112, 113, 102; 15/234.5
See application file for complete search history.

(56) References Cited

U.S. PATENT DOCUMENTS

| | | | | | |
|---|---|---|---|---|---|
| 2,633,782 | A * | 4/1953 | Clement | 404/133.1 |
| 2,737,094 | A * | 3/1956 | Jackson | 404/113 |
| 3,458,885 | A * | 8/1969 | Danielsson | 15/50.1 |
| 3,515,043 | A * | 6/1970 | Austin | 404/113 |
| 3,621,086 | A | 11/1971 | Guide | |
| 4,185,431 | A | 1/1980 | Brownlee | |
| 4,265,609 | A | 5/1981 | Kitahara | |
| 4,315,700 | A * | 2/1982 | Heiligtag et al. | 404/111 |
| 4,507,015 | A * | 3/1985 | Furukawa et al. | 404/102 |
| 4,591,291 | A * | 5/1986 | Owens | 404/118 |
| 5,160,034 | A * | 11/1992 | Potter | 209/38 |
| 5,855,958 | A | 1/1999 | Nash | |
| 6,824,604 | B1 | 11/2004 | Noack | |
| 6,923,595 | B1 | 8/2005 | Chek | |
| 7,195,424 | B2 * | 3/2007 | Lindley | 404/118 |
| 7,270,469 | B2 | 9/2007 | Goode | |
| 7,572,048 | B2 | 8/2009 | Morey | |
| 7,686,538 | B2 * | 3/2010 | Lutz et al. | 404/114 |
| 2006/0105161 | A1 | 5/2006 | Brandenburger | |
| 2007/0234679 | A1 | 10/2007 | Metten | |
| 2009/0042044 | A1 | 2/2009 | Abecassis | |
| 2010/0239368 | A1 * | 9/2010 | Lickel | 404/84.5 |

* cited by examiner

*Primary Examiner* — Thomas B Will
*Assistant Examiner* — Abigail A Risic
(74) *Attorney, Agent, or Firm* — Scott L. Harper; Harper Washam LLP

(57) ABSTRACT

The apparatus and method comprise a concrete float with a vibratory additive broadcaster assembly attached therewith. The broadcaster assembly is suspended above the plane of the finishing tool with a vibratory source attached. The broadcaster assembly is filled with an additive and the apparatus is placed on a wet, concrete surface which is to be treated and finished, by a user. Actuation of a power switch by the user activates the vibratory source resulting in the substantial broadcast of additive on to the concrete surface at the desired location(s) on the slab as determined by the user. The additive is then integrated into the concrete by passage of the float over the treated concrete surface.

16 Claims, 4 Drawing Sheets

APPARATUS AND METHOD FOR APPLYING ADDITIVES TO A CONCRETE MIX

BACKGROUND OF THE INVENTION

The present invention relates in general to concrete and masonry construction, and, more particularly, to an apparatus and method for introducing pigments, colorants and other additives to the surface of plastic concrete.

Concrete can be molded into a variety of shapes and configurations including driveways, decks, concrete masonry units (CMU), blocks, beams, columns, decorative stones, mosaics and facades as examples of decorative concrete applications. Many of these products include a colorant or pigment which provides color to the application. Concrete additives such as plasticizers, pigments, colorants or dispersants are added to concrete mixes in order to increase the plasticity of the concrete, which improves the workability of the concrete prior to hardening. Color pigments may be added to concrete mix in order to produce a certain color for aesthetic enhancement of the concrete.

The addition of concrete pigment and other admixtures or additives to concrete mix is known in the art. For example, U.S. Pat. No. 7,270,469 discloses an apparatus and method for adding pigmentation to a concrete mix by using a pigmentation dispenser with a hopper and two rotors wherein the pigment is dispensed onto concrete mix traveling on a conveyor. The concrete mix and dispensed pigment are then conveyed to a mixer which mixes them together. However, such methods require the addition of pigment to the entire batch of concrete to be mixed resulting in a monolithic coloring of the entire concrete mixture, some of which will never be seen or viewed as certain of the concrete structure surfaces after finishing will face the ground or other structures and remain hidden from view. As a result, there is a certain waste volume of pigment generated in such mixing and coloring regimes. Likewise, if a deeper color is required, then the entire batch of colored concrete must be reintroduced to the coloring and mixing system again resulting in the additional waste of colorant to color then entire batch of concrete to be manipulated into a slab, façade, or CMU. Moreover, these methods of adding color hardeners or additives to a concrete mix or slab are performed prior to finishing or shaping of the concrete, thereby increasing the time required to complete the process or project.

The addition of color additives to cast in place concrete has traditionally been by hand. As a plastic concrete slab is being finished, a worker will take a handful of powderized color hardener and disperse it over the slab, in effect flinging a handful of dry color hardener powder into the air which disperses and falls by gravity on to the wet or plastic concrete surface. A color hardener is a powder that is applied to the surface of plastic, cast in place concrete. It colors the concrete and acts to "harden" the concrete slab.

This method of color hardener application has serious drawbacks. For example, the color hardener powder is dispersed erratically in an uncontrolled amount and in variable concentration on to the concrete slab, which can result in a non-uniform color. Depending on prevailing environmental conditions (e.g. wind), a substantial amount of the color hardener is dispersed and deposited on other surfaces close to the slab and goes to waste, as well as potentially bleeding color undesirably on other surfaces. A more serious drawback is that the powder may be inhaled by the worker and other workers on the site, potentially leading to detrimental physiological effects (sneezing, asthma or other undesirable health conditions). As a result, a need exists for an apparatus and method which effectively and safely broadcasts concrete color hardener or other additives on to a plastic cast in place slab.

Therefore, one object of the present invention is to provide an apparatus and method for the controlled dispensation and application of concrete colorants or additives to concrete surfaces without the need to monolithically mix such colorants or additives prior to finishing or manipulation of the concrete into the desired shape or structure.

A further object of the present invention is provide an apparatus and method which provides a mechanism by which pigments or other additives may be introduced to the concrete mixture in specific areas in the discretion of the operator as the concrete is being finished.

A further object of the present invention is the provision of an apparatus and method for introducing color hardener or other additives to concrete mix which is efficient in operation and conserves the volume of additive required to complete the concrete treatment process.

SUMMARY OF THE INVENTION

In accordance with the present invention, a method and apparatus for broadcasting dry color hardener while finishing a concrete surface is provided as disclosed herein. The apparatus comprises a concrete float with a vibratory broadcaster assembly attached therewith. The broadcaster assembly is suspended above the plane of the finishing tool, such as a bull float or other finishing tool, with a vibratory source attached. The broadcaster assembly is filled with color hardener or other additive and the apparatus is placed on a wet, concrete surface which is to be treated and finished by a user. Actuation of a power switch activates the vibratory source resulting in the substantial broadcast of color hardener on to the plastic concrete surface at the desired location(s) as determined by the user. The color hardener or other additive is then integrated into the concrete by passage of the float or finishing tool over the concrete surface.

Other technical advantages of the present invention will be readily apparent to one skilled in the art from the following figures, descriptions and claims. While specific advantages and embodiments have been enumerated above, various embodiments may include all, some, or none of the enumerated advantages.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

For purposes of teaching and discussion, it is useful to provide some overview as to the way in which the invention disclosed herein operates. The following information may be viewed as a basis from which the present invention may by properly explained. Such information is offered for purposes of explanation only and, accordingly, should not be construed to limit the broad scope of the present invention and its potential applications.

Figure 1:
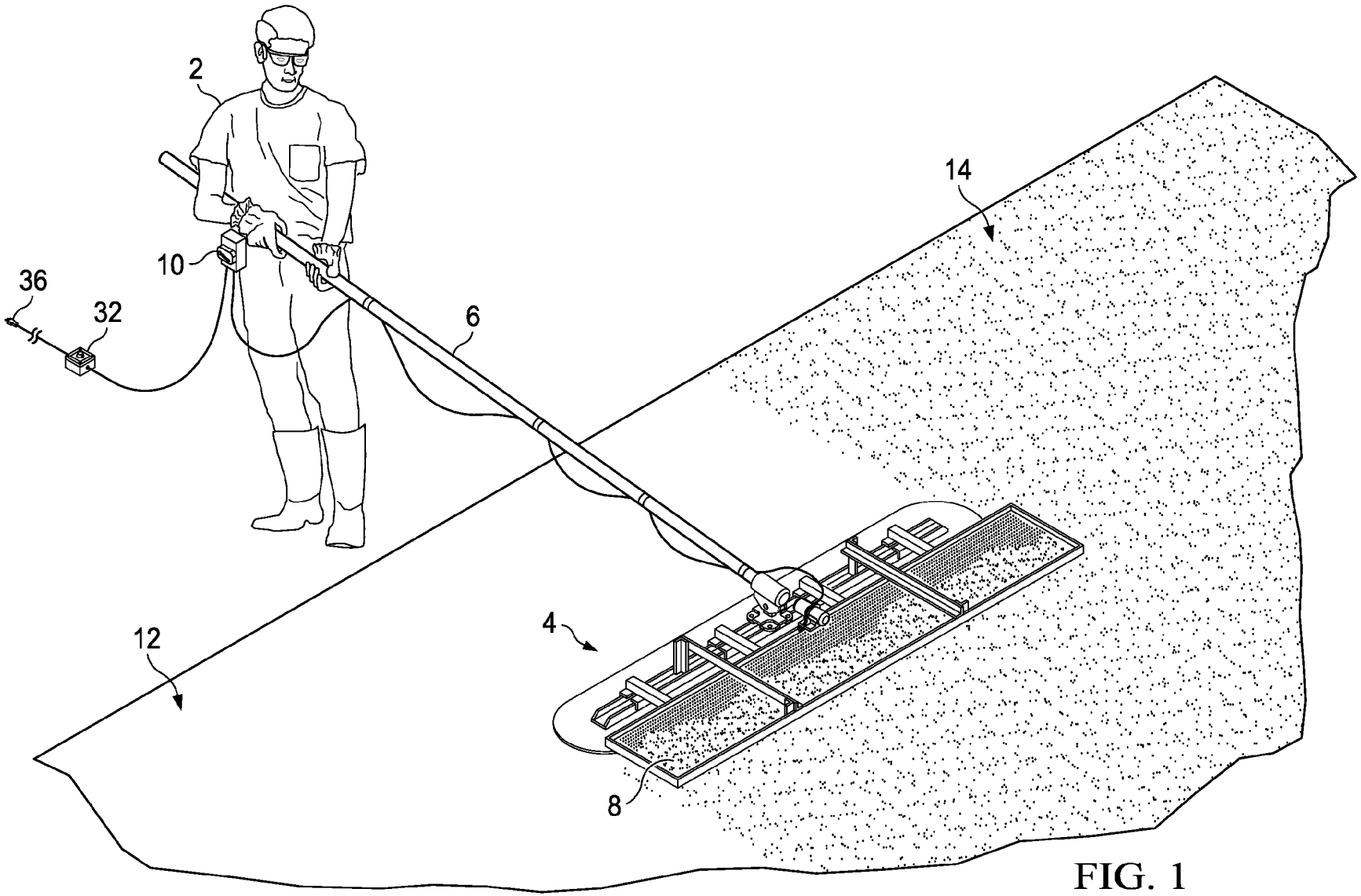
FIG. 1 is a perspective view of the broadcast float tool assembly apparatus as used in a typical concrete finishing operation in accordance with the present invention.

FIG. 1 depicts a user 2 operating the broadcast float device 4 on a typical concrete surface 12 finishing job. As will be described in further detail hereafter, the broadcast float assembly 4 is operated by user 2 manipulating an extendible pole 6 which is detachably secured to the broadcast float assembly 4. Color hardener or other additive 8, which may be in granular, powder, or pelletized form, is added to and suspended above the concrete surface by the broadcaster assembly 4 then dispersed on to the concrete slab 12 from the broadcast assembly 4 by actuation of a vibratory source controlled by switch 10 which vibrates the broadcast assembly in such fashion as to broadcast the additive on to the surface of concrete slab 12.

In one embodiment, the switch 10 may detachably secured on or about the person of user 2, such as clipped to the user's belt or suspended about the user 2 with a strap or button. This allows the user 2 to broadcast the color hardener 8 in areas on surface 12 as desired without the aid of additional persons. In another embodiment switch 10 may rest on the ground, along with variable control switch 32 or without, and be controlled by the user 2 or another person as desired. As shown in FIG. 1, the treated concrete surface 14 denotes the effect of application of an additive 8 thereto in this case shown as a concrete colorant, while concrete surface 12 remains untreated with additive 8. In another embodiment, switch 10 includes a variable speed switch 32 so as to allow the user 2 to adjust speed of vibratory cycles applied to the broadcast float assembly 4 thereby increasing or decreasing the amount of additive 8 which is broadcast on to the concrete surface 12.

Figure 2:
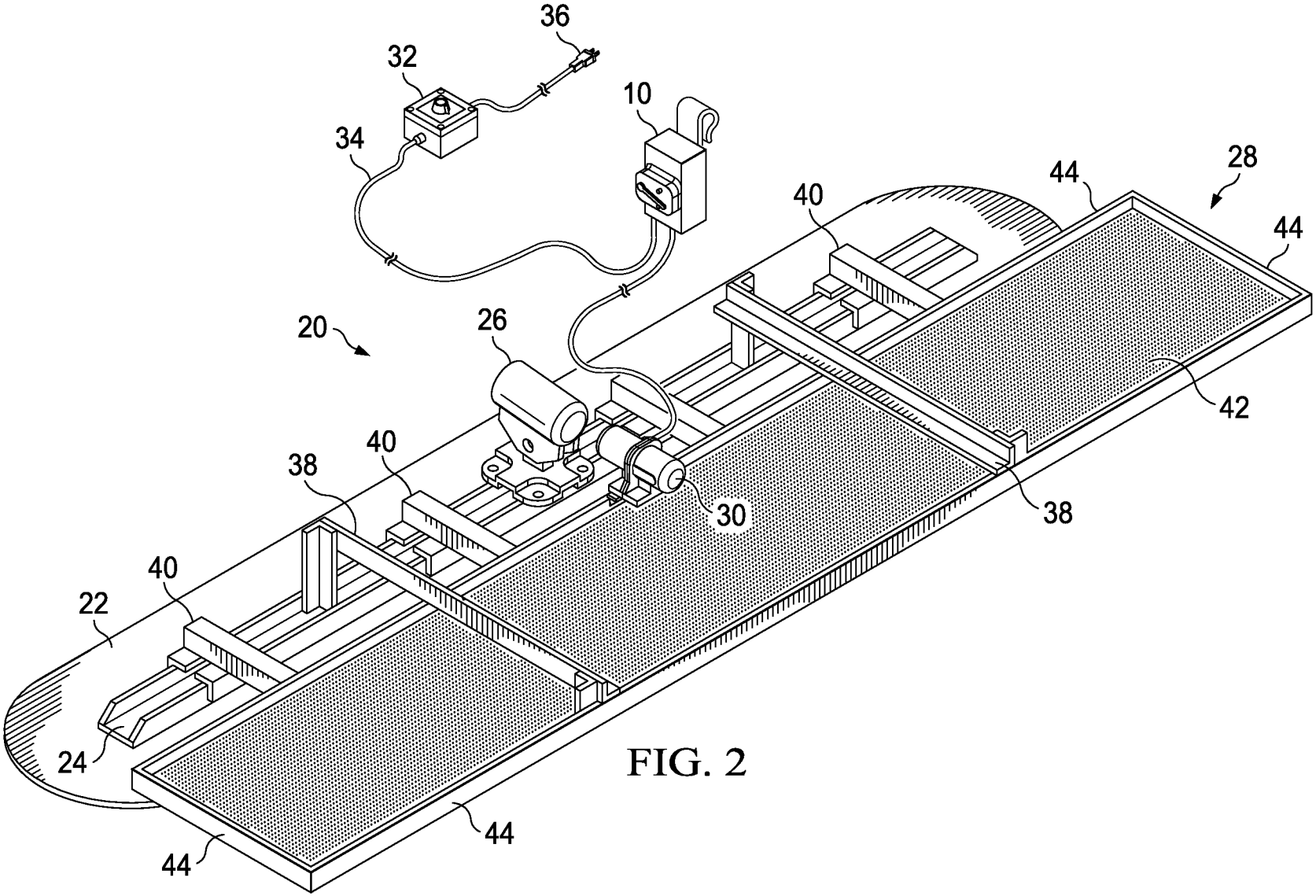
FIG. 2 is a close-up perspective view of the broadcast float assembly in accordance with the present invention.

Turning to FIG. 2, the broadcast float assembly 20 components are shown in further detail. Broadcast float assembly 20 includes a float plate 22, a float plate mount bracket 24, a tool receiver 26, a broadcaster 28, and a vibratory source 30 with controller switch 32 in electrical communication with vibratory source 30 via cord 34. Electrical power is supplied to the control switch 32 and vibratory source by connecting plug 36 to an electric power source of appropriate voltage, which in typical application is 110 volts-220 volts. In another embodiment, electrical power is supplied by battery, generator or other capacitance means as known in the art. For example, a 24 Volt battery pack would provide adequate power for operation of the device 4 when it is being used in locations where direct electrical power is not available or easily accessed. It is contemplated that in other embodiments the broadcast float assembly 20 may be used with or integrated with other floats, screeds, tampers or other concrete finishing equipment as known in the art.

Broadcaster 28 includes screen 42 secured to screen frame 44. Screen 42 is comprised of a mesh or metal type screen with holes of punched therein to allow for additive flow through the screen 42 upon activation of the vibratory source 30 which imparts vibrations or shockwaves to the broadcaster 28 causing the dispersion of additive through the holes in screen 42. In one embodiment, screen 42 is made of 050 gauge aluminum metal with 3/32 inch diameter staggered holes punched therein. Screen frame 44 is constructed of aluminum metal or other suitable structural material. Screen frame 44 acts to support screen 42 and also as a containment wall around the perimeter of screen 42 for keeping the additive poured on to the screen 42 surface in place and ready for application. In one embodiment, screen frame 44 is made of aluminum metal tubing or channel of sufficient strength to contain and support screen 40 when loaded with additive for broadcast. In the embodiment shown, vibratory source 30 is attached to the broadcaster 28 by weld, bolt or other attachment means as known in the art.

Broadcaster 28 is secured to and supported by float plate 22 via upper supports 38 and lower supports 40. The upper supports 38 and lower supports 40 are secured to the float plate 22 via the float plate mount bracket 24 by weld, bolt or other attachment means as known in the art. Upper supports 38 and lower supports 40 are secured to the broadcaster 28 by weld, bolt or other attachment means as known in the art. Vibratory source 30 is detachably secured to the broadcaster 28 by weld, bolt or other attachment means as known in the art. Vibratory source 30 may be attached to the broadcaster 28 at any suitable attachment point and its position shown in the Figures herein is not to be construed as a limitation of the architecture disclosed herein.

Figure 3:
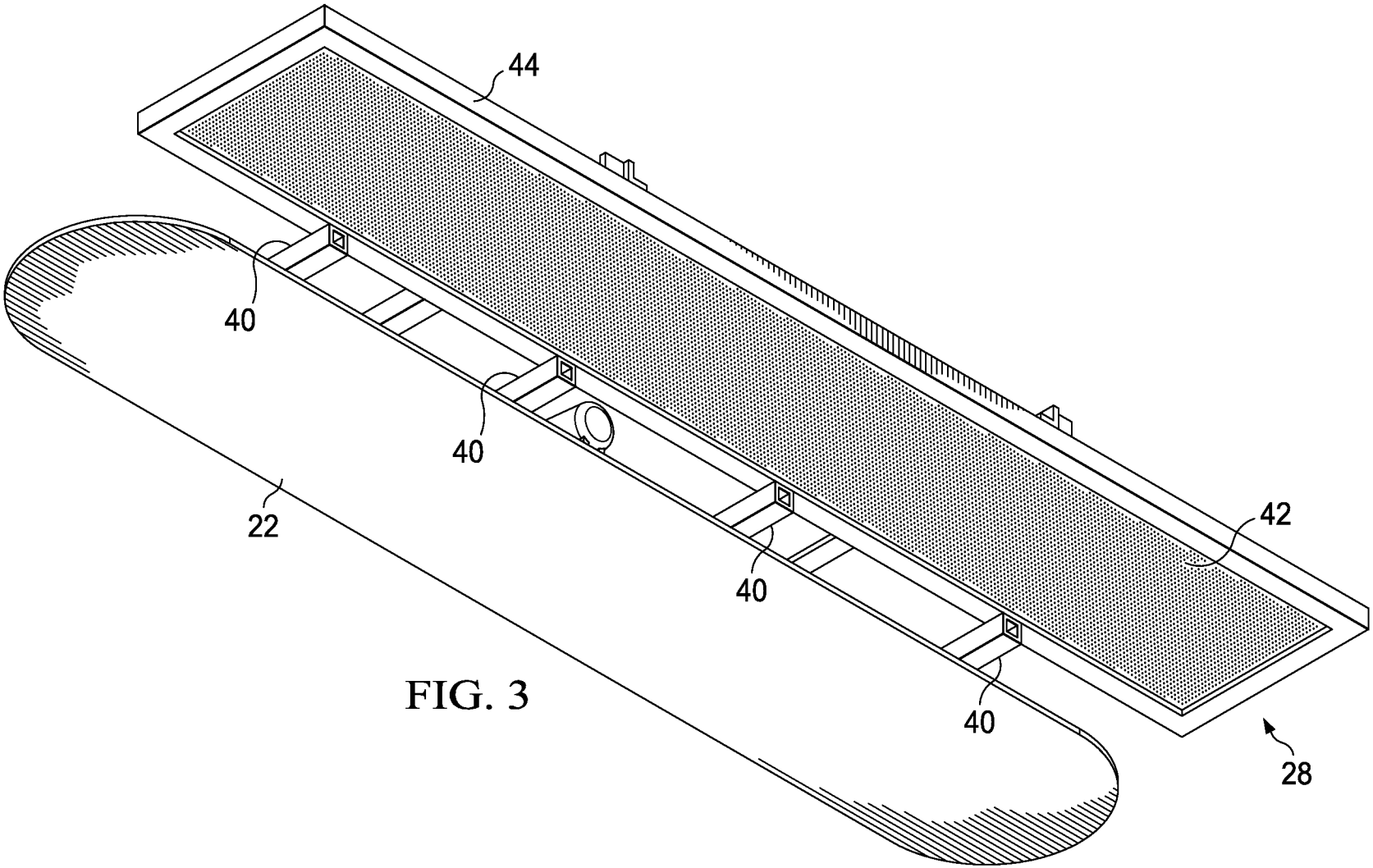
FIG. 3 is a bottom perspective view of the broadcast float assembly in accordance with the present invention; and, FIG. 4 is a rear perspective view of the broadcast float assembly in accordance with the present invention.

With reference to FIG. 3, the broadcast float assembly is shown from a bottom perspective view. Lower supports 40 are depicted in greater detail and shown supporting the broadcaster 28 in the horizontal plane above the plane of the float plate 22. In one embodiment, the broadcaster 28 is suspended between one to six inches above the horizontal float plate 22 plane. Various heights may be utilized depending on the desired broadcast range or the application or environmental conditions (wind conditions) prevailing at the time of additive broadcast. In one embodiment, the broadcaster 28 height above the float plate 22 may be adjusted by loosening/tightening bolts, screws, nuts or latching/unlatching pins located at the attachment points for the upper supports 38 and lower supports 40. It is contemplated that in alternative embodiments adjustable connections or connector means may be utilized to allow the operator to adjust the height of the broadcaster 28 relative to the float plate 22 as desired.

Figure 4:
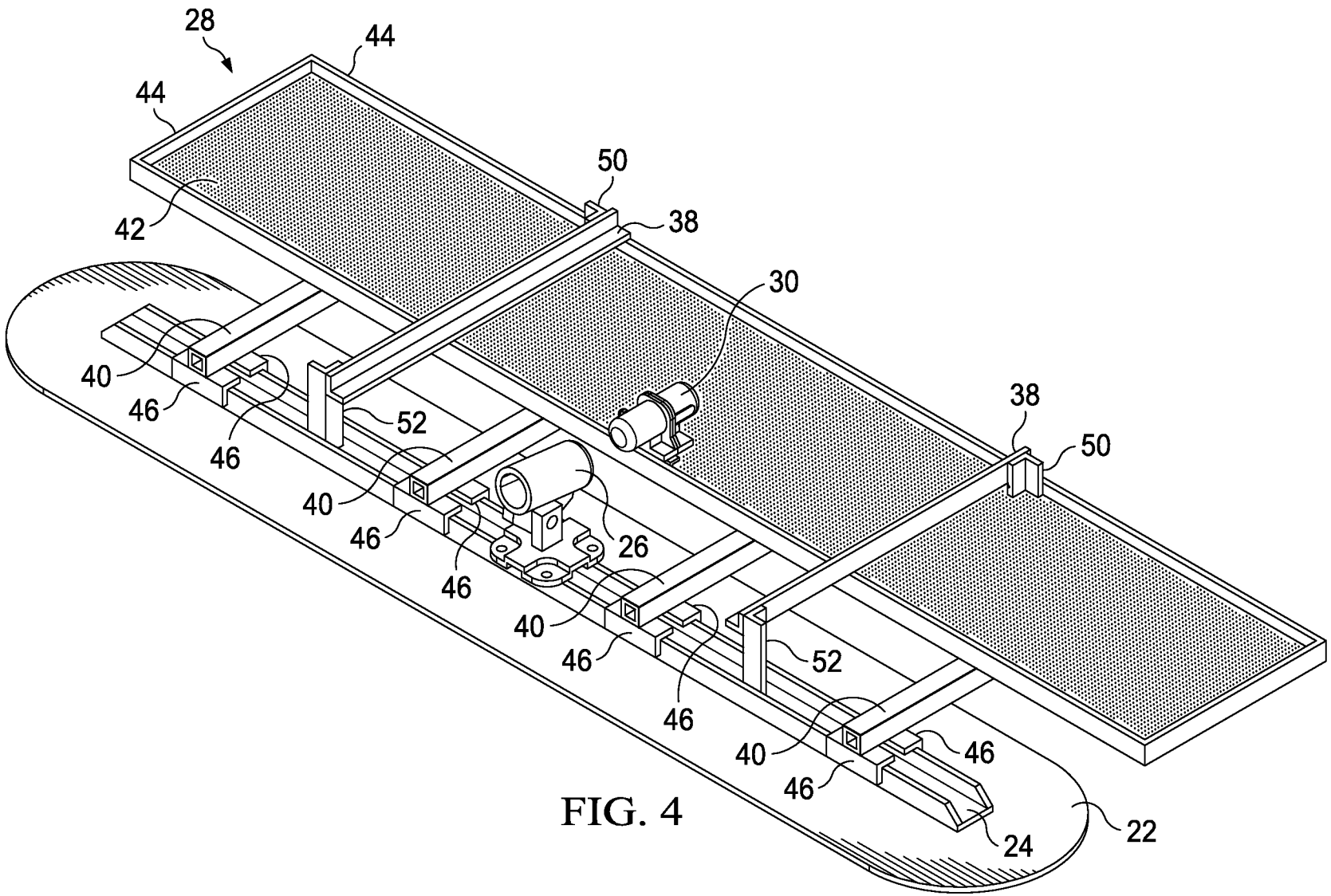

Turning to FIG. 4, a rear perspective view of the broadcast float apparatus is shown. In this embodiment, four lower supports 40 are shown with two upper supports 38 shown extending across the top portion of the broadcaster 28. Upper supports 38 are shown attached to the broadcaster 28 via channel supports 50 which are secured to screen wall 44 and to the float plate mount bracket 24 via channel supports 52. Lower supports are shown attached to the float plate mount bracket via channel supports 46. Channel supports 46,50 may optionally be fashioned out of metal or other structurally sufficient materials in various shapes such as tubing, channel, rod or other geometric shapes capable of providing sufficient support for the broadcaster 28 to the float plate 22.

In the depicted embodiment, vibratory source 30 is comprised of an electric motor with offset weights attached to a driveshaft dispensed therein so as to provide a source of vibrations or shock waves sufficient to induce the flow of additive resting on the top surface of screen 42 through the holes in the screen 42 and down on to the concrete surface being finished. A variable speed vibratory device may be utilized with the vibratory cycle speed controlled by the user via the control switch or a variable speed switch or both. As the cycle speed is increased, the amount of color hardener or additive broadcast increases, thereby resulting in a higher concentration of additive being applied to the concrete surface. As the vibratory cycle speed is lowered, smaller volumes of color hardener or additive are dispersed resulting in lower concentrations being applied to the concrete surface.

In application and with reference to the all of the figures herein described, a user can utilize the broadcast float apparatus 10 to selectively apply additives to the desired areas of a concrete slab which is being finished. For example, a spotted color pattern could be easily colored into the concrete using the apparatus and method disclosed herein. Additionally, the apparatus 10 allows a user to apply color hardener or other additives in areas of a plastic slab where traditional "hand throwing" techniques could not be utilized. The operator may simply add the requisite number of tool extension poles to position the apparatus 10 in the desired area for the broadcast of color hardener or other additives. Likewise, in other embodiments of the invention it may be desirable to use a plasticizer in select portions of the plastic slab being finished to alter or extend the curing time for a certain portion of the slab. This would facilitate light foot traffic on portions of the untreated slab and allow users to insert forms, columns or other objects in select areas of the slab which have remained in a plastic, uncured state.

While the invention has been particularly shown and described with reference to a various embodiments, it will be understood by those skilled in the art that various changes in form and detail may be made therein without departing from the spirit and scope of the invention.

I claim:

1. A broadcaster float assembly apparatus, comprising:

a float plate;

a float plate mount bracket attached to a top side of the float plate;

a tool receiver attached to the float plate mount bracket;

a broadcaster comprising a screen attached to a circumferential screen frame, wherein the broadcaster is suspended above the horizontal float plate plane and substantially forward and separate from the float plate by an upper support attached to a top side of the screen frame and a lower support attached to a bottom side of the screen frame and where the opposite ends of the upper support and lower support are attached to the float plate mount bracket, and wherein the broadcaster is operable to substantially contain and substantially support a powdered or pelletized additive resting on the broadcaster screen;

a vibratory source detachably secured to the broadcaster which is operable to disperse the additive from the broadcaster upon actuation of the vibratory source, and;

a control switch for controlling the vibratory source.

2. The apparatus of claim 1 wherein the vibratory source is a variable speed motor.

3. The apparatus of claim 1 wherein the broadcaster screen further comprises a screen with at least one 3/32 inch diameter hole.

4. The apparatus of claim 1 wherein the broadcaster is manufactured from aluminum metal.

5. The apparatus of claim 1 wherein the broadcaster screen is mounted between one to six inches above the horizontal plane of the float plate.

6. The apparatus of claim 1 wherein the additive is concrete color hardener.

7. The apparatus of claim 1 wherein the float plate is one of a bull float, a screed or a tamper.

8. The apparatus of claim 1 further comprising a variable speed switch.

9. The apparatus of claim 1 wherein the control switch is worn about the operator's person.

10. A method, comprising:

supporting a broadcaster float assembly in contact with a wet concrete surface with a float plate having a float plate mount bracket attached to the top side of the float plate;

filling a broadcaster comprising a broadcaster screen attached to a circumferential screen frame suspended above the horizontal float plate plane and substantially forward and separate from the float plate by an upper support attached to a top side of the screen frame and a lower support attached to a bottom side of the screen frame and where the opposite ends of the upper support and lower support are attached to the float plate mount bracket, with a powdered or a pelletized additive resting on the broadcaster screen for dispersion on to the wet concrete surface;

dispersing a substantial portion of the additive from the broadcaster on to the wet concrete surface by activating a vibratory source mounted to the broadcaster assembly; and, moving the broadcaster float assembly on the wet concrete surface by inserting a pole into the tool receiver attached to the float plate mount bracket.

11. The method of claim 10 further comprising:

inhibiting the substantial dispersion of the additive by substantially reducing the vibrations output by the vibratory source.

12. The method of claim 10 wherein the volume of additive dispersed is substantially correlated to the cyclical speed of the vibratory source.

13. The method of claim 10 wherein the volume of additive dispersed is substantially correlated to the height differential between the float plate and broadcaster.

14. The method of claim 10 wherein the additive is concrete color hardener.

15. The method of claim 10 wherein the float plate is one of a bull float, a screed, or a tamper.

16. The method of claim 10 wherein the volume of additive dispensed is controlled by manipulation of a variable speed switch.

* * * * *